US006997991B2

(12) United States Patent
von Keudell et al.

(10) Patent No.: US 6,997,991 B2
(45) Date of Patent: Feb. 14, 2006

(54) DEVICE FOR CLEANING A POWDER COATING BOOTH AND POWDER COATING BOOTH WITH CLEANING DEVICE

(75) Inventors: Leopold von Keudell, Salem (DE); Hanspeter Dietrich, Rüthi (CH)

(73) Assignee: J. Wagner AG, Altstatten (CH)

( * ) Notice: Subject to any disclaimer, the term of this patent is extended or adjusted under 35 U.S.C. 154(b) by 0 days.

(21) Appl. No.: 10/815,597

(22) Filed: Apr. 1, 2004

(65) Prior Publication Data

US 2005/0000419 A1 Jan. 6, 2005

(30) Foreign Application Priority Data

Apr. 11, 2003 (DE) ..... 203 05 947 U

(51) Int. Cl.
*B05B 1/28* (2006.01)
*B05B 15/12* (2006.01)

(52) U.S. Cl. ..... 118/326; 118/309; 118/63; 118/DIG. 7; 454/50; 15/301

(58) Field of Classification Search ..... 118/309, 118/DIG. 7, 326, 63; 55/DIG. 46; 454/50
See application file for complete search history.

(56) References Cited

U.S. PATENT DOCUMENTS 4,787,330 A 11/1988 Bolf
4,926,746 A 5/1990 Smith
5,690,995 A * 11/1997 Fischli et al. ..... 427/180
5,762,548 A 6/1998 Milojevic et al.
5,861,062 A * 1/1999 Reiss ..... 118/326
6,589,345 B1 7/2003 Gelain
6,821,346 B1 * 11/2004 Ainsworth et al. ..... 118/326

FOREIGN PATENT DOCUMENTS

| | | |
|---|---|---|
| DE | 70 14 433 U | 4/1970 |
| DE | 44 17 188 A1 | 11/1995 |
| DE | 297 05 487 U1 | 5/1997 |
| DE | 196 44 360 A1 | 4/1998 |
| DE | 299 07 779 U1 | 1/1999 |
| DE | 100 28 553 A1 | 12/2001 |
| DE | 202 18 192 U1 | 3/2003 |
| EP | 11 38 394 A1 | 10/2001 |
| WO | 97/14508 A1 | 4/1997 |

OTHER PUBLICATIONS

German Search Report for corresponding Application 203 05 947.6, dated May 6, 2004.

* cited by examiner

*Primary Examiner*—Chris Fiorilla
*Assistant Examiner*—Yewebdar Tadesse
(74) *Attorney, Agent, or Firm*—Renner, Otto, Boisselle & Sklar, LLP

(57) ABSTRACT

Device for cleaning a powder coating booth and powder coating booth with cleaning device. The device for cleaning a powder coating booth is provided with a first air distribution batten arranged on the floor of the powder coating booth. Also provided is a second air distribution batten arranged on a side of the powder coating booth and a suction channel with a suction slot for sucking excess powder out of the booth. The first and the second air distribution batten are provided in order to blow excess powder in the direction of the suction slot.

24 Claims, 5 Drawing Sheets

Detail Y

Detail Z

DEVICE FOR CLEANING A POWDER COATING BOOTH AND POWDER COATING BOOTH WITH CLEANING DEVICE

TECHNICAL AREA

The invention concerns a device for cleaning a powder coating booth and a powder coating booth with cleaning device.

When objects have to be electrostatically coated with powder, the powder is sprayed by means of a powder spraying pistol onto the object that is to be coated. During the coating process the objects that are to be coated are as a general rule situated inside a booth. Since not all the powder particles sprayed by the spraying pistol during the coating process remain in adhesion on the object, the excess powder, which is known as overspray, has to be removed from the booth. One of the reasons why this has to be done is that the surroundings outside the booth have to be kept free of powder. Furthermore, the explosion danger increases once the cloud of powder dust suspended in the booth exceeds a certain concentration. It is therefore necessary to avoid this. Another reason for removing excess powder from the interior of the booth already during its operation is that the additional cleaning measures required when colours have to be changed will take less time if the booth has already been substantially liberated of the excess powder.

BACKGROUND OF THE INVENTION

As far as prior art is concerned, from DE 196 44 360 there is known a colour spraying booth for powder coating in which the excess lacquer particles are conveyed into a suction channel situated at the centre of the booth floor, and to this end there are provided two transverse airstreams in the horizontal direction. The transverse airstreams are produced by blowing air into the booth through horizontal slots in the side walls of the colour spraying booth. On each side wall of the colour spraying booth there is also provided a nozzle, constituted by a sheet metal part, by means of which the airstream produced by means of a ventilator is introduced into the interior of the colour spraying booth. When the cleaning of the booth floor is performed in this manner, however, it is associated with the drawback that the sheet metal parts attached to the outside of the sides considerably increase the width of the booth. A further disadvantage consists of the fact that the longitudinal sides of the booth have to be provided with slots for the sheet metal parts. If it does not prove possible to suck up a sufficient quantity of secondary air from outside via these openings and blow it into the booth, the openings will also have to be sealed after the building in of the sheet metal parts in order to avoid powder being lost from the booth through them.

A further possible way of designing a booth for powder spray coating with a cleaning device is known from the German patent specification DE 100 28 553. The powder spray coating booth is provided with a suction channel arrangement at the lower end of the booth interior for sucking air and excess powder out of the interior of the booth. The suction channel arrangement is designed in such a manner that that a non-uniform distribution of the suction airstream is brought into being at the lower end of the booth interior along the transport path of the object. The manner in which this is obtained is that the far greater part of the exhaust air is made to flow out of the booth space along the transport path of the object and through suction passages that are arranged in the vicinity of the passages that permit the object to be moved into and out of the booth space and therefore at the two ends of the booth. To this end the suction channel present in the booth is covered by means of two displaceable channel covering parts. Furthermore, inside the booth there are provided compressed air distribution lines, so that the excess powder is blown in the direction of the suction channel. But this construction form has the disadvantage that moving parts are present in the booth, which enhances the breakdown liability of the plant. Furthermore, the two displaceable channel covering parts and the slope of the booth floor make it difficult to walk in the booth.

DESCRIPTION OF THE INVENTION

One object of the invention is to disclose a device for cleaning a powder coating booth, as well as a powder coating booth with a cleaning device, such that the booth floor can be readily walked upon and there is also assured an efficient and exceptionally effective cleaning of the booth.

The object is attained by means of a device for cleaning a powder coating booth having the characteristics of claim 1.

The device for cleaning a powder coating booth in accordance with the invention is provided with a first air distribution batten for mounting on the floor of the powder coating booth and a second air distribution batten on a side of the powder coating booth. Over and above this, there is provided a suction channel with a suction slot to evacuate any excess powder, the function of the first and the second air distribution batten being that of blowing excess powder in the direction of the suction slot.

The object is furthermore attained by a powder coating booth with cleaning device having the characteristics of claim 13.

The powder coating booth with cleaning device in accordance with the invention is provided with a first air distribution batten arranged on the floor of the powder coating booth and a second air distribution batten arranged on a side of the powder coating booth. The powder coating booth is also provided with a suction channel having a suction slot, the first and the second air distribution batten being provided to blow excess powder in the direction of the suction slot.

Advantageous further developments of the invention derive from the characteristics described in the dependent claims.

In a first development of the invention there is provided a third air distribution batten for a second side of the powder coating booth. Furthermore, there is also provided a second suction channel with a suction slot, the third air distribution batten being provided in order to blow excess powder in the direction of the suction slot of the second suction channel. This makes it possible to further enhance both the efficiency of the cleaning and the region that is capable of being cleaned.

In a second development of the device in accordance with the invention the first and/or the second and/or the third air distribution batten is/are subdivided into several subsections, through each of which air can be blown into the booth independently of the others. In this way it is possible for the entire region that is to be cleaned to be subdivided into individual segments that can be cleaned at a given time. When this is done and the individual segments are cleaned one after the other, the total air consumption per unit of time can be reduced. It also leads to a reduction of the noise level.

In a third development of the device in accordance with the invention there is provided a control by means of which the batten subsections can be individually controlled. This makes it possible to decide in a purposeful manner which of the individual batten subsections are to be activated in order to assure cleaning of the corresponding segment.

In the device in accordance with the invention it will be advantageous if two batten subsections situated opposite each other are always jointly activated by means of one valve. In this way the cleaning efficiency can be further stepped up.

In the device in accordance with the invention it will also be advantageous if the first and/or the second and/or the third air distribution batten are provided with several nozzles, these nozzles being arranged in such a manner that the airstream produced by the nozzles will spread substantially in the direction transverse to the longitudinal axis of the air distribution batten. This makes it possible to produce a uniformly distributed airstream of sufficient volume.

Over and above this, the nozzles of the first air distribution batten of the device in accordance with the invention may be arranged in such a manner that the airstream that can be produced by the nozzles will be oriented substantially parallel to the booth floor. This makes it possible for the floor to be uniformly freed of excess powder.

With a view to attaining the object of the invention it is further suggested that the first air distribution batten should be provided with nozzles on both sides of its longitudinal axis. This makes it possible to further enlarge the area that is to be cleaned.

In a further development of the device in accordance with the invention the first and/or the second and/or the third air distribution batten are provided with nozzles arranged in groups. The airstream produced by the nozzles arranged in groups produces an additional secondary air-stream in the region in which there are no nozzles, so that a substantial cleaning effect can be obtained even with a small quantity of compressed air.

According to yet another characteristic of the invention, this can be even further improved if there is provided a container with a reserve of compressed air that is connected to the air distribution battens. This container with its compressed air reserve makes it possible to make smaller demands on the compressed air generator.

In a further development of the device in accordance with the invention the first and/or the second and/or the third air distribution batten extend substantially over the entire length of the floor of the powder coating booth. This makes it possible to clean the entire floor of the powder coating booth.

Lastly, the first air distribution batten can be arranged in the middle of the floor. This has the advantage that a uniform cleaning of the floor is obtained with a minimized compressed air consumption.

According to a further characteristic of the invention, the first and/or the second and/or the third air distribution batten may be made of plastic material, preferably PVC, POM or Teflon. In this way it is possible to minimize the adhesion of excess powder to the air distribution battens.

In a first development of the powder coating booth with cleaning device the suction slot is situated between the side and the floor of the powder coating booth. This has the advantage that the floor of the powder coating booth can be further lowered without the lowering leading to a reduction of the cleaning efficiency.

In a second development of the powder coating booth with cleaning device there is provided a second suction channel with a suction slot, with both the first and the second suction channel extending along the longitudinal side of the powder coating booth.

In a third development of the powder coating booth with cleaning device an oblique surface in the booth constitutes the transition between the side and the floor. The second and/or the third air distribution batten are arranged above the oblique surface. This has the advantage that the oblique surface and/or the oblique surfaces in the booth can be cleaned with the help of the second and/or the third air distribution batten, while the floor of the booth can be cleaned with the help of the first air distribution batten. Moreover, behind the oblique surfaces there will be sufficient room to accommodate both the suction channels.

Advantageously, the oblique surface of the powder coating booth in accordance with the invention will be provided with a bevelled edge in its lower region, the surface constituted by this edge being such that an acute angle is enclosed between it and the floor. Among others, this avoids powder accumulations being formed in the region of the suction slot. Furthermore, it also improves the suction effect.

In a particular embodiment of the powder coating booth the nozzles of the second and/or the third air distribution batten are oriented in such a manner that the airstream that can be produced by the nozzles is oriented substantially parallel to the oblique surface. This increases the efficiency of the airstream during the cleaning.

With a view to attaining the object of the invention, it is further suggested that the powder coating booth should be designed in such a manner that the airstream produced by the nozzles is smaller than the airstream sucked out of the booth.

Lastly, in the powder coating booth in accordance with the invention the first and/or the second suction channel may be made of metal, preferably an alloy steel.

BRIEF DESCRIPTION OF THE DRAWINGS

The invention will now be considered in greater detail by describing several embodiments with the help of the 14 figures attached hereto.

EMBODIMENTS OF THE INVENTION

Figure 1:
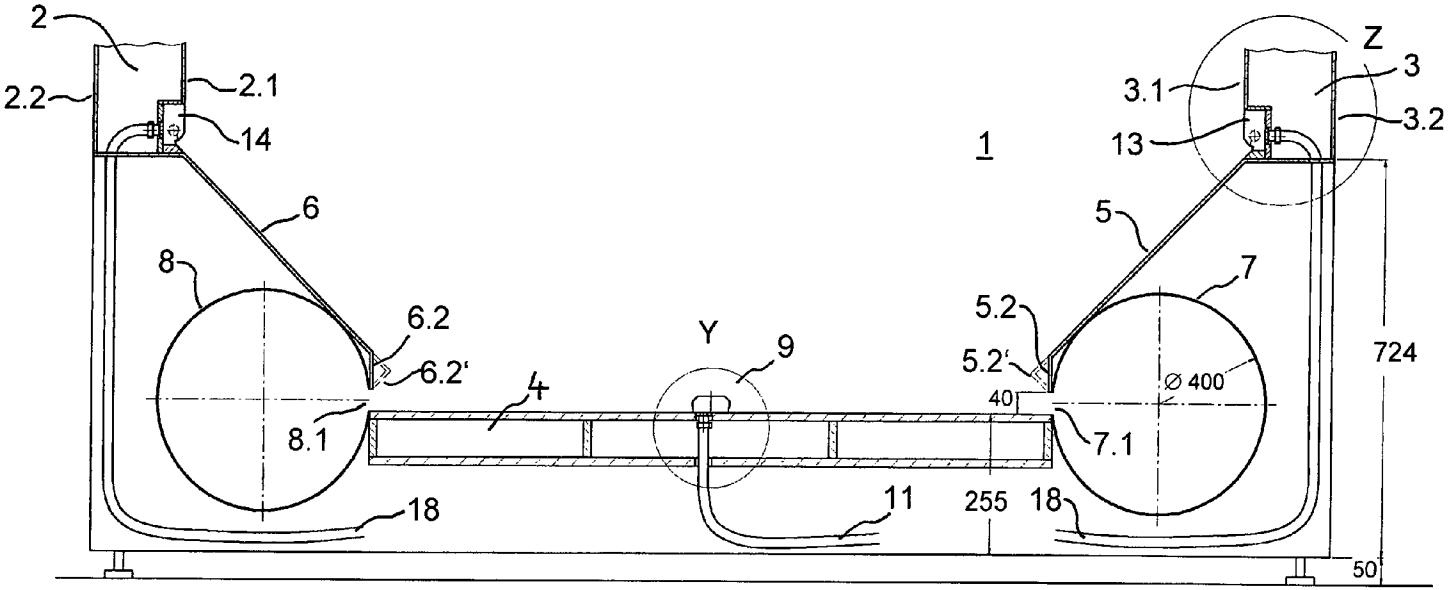
FIG. 1 shows a cross section through the lower part of a powder coating booth in accordance with the invention.

The powder coating booth 1 equipped with a cleaning device in accordance with the invention, of which the cross section shown in FIG. 1 represents only the lower region, has a left-hand side wall 2 and a right-hand side wall 3. Each of the side walls 2 and 3 has attached to it one of the oblique surfaces 5 and 6, which continue downwards into the vicinity of the floor 4 of the powder coating booth. Between the end of the oblique surface 5 and the floor 4 there is situated a so-called suction slot 7.1 that extends over the entire length of the floor 4 of the booth 1. The suction slot 7.1 is provided in order to permit excess powder to be sucked out of the booth via the suctions channel 7. The height of the suction slot 7.1 may amount to about 40 mm, as in the embodiment illustrated by FIG. 1.

In a first embodiment, which in FIG. 1 is indicated by means of a continuous line, the oblique surface 5 may be provided with a bevelled edge in its lower region, thereby bringing into being a surface 5.2 that forms a right angle with the floor 4. In a second embodiment, which in FIG. 1 is indicated by means of a dotted line, the bevelled edge is arranged in such a manner that the surface 5.2' thereby brought into being forms an acute angle with the floor 4. The lower left-hand side of the powder coating booth 1 with the oblique surface 6, the vertical surface 6.2 or the oblique surface 6.2', the suction channel 8 and the suction aperture 8.1 is basically structured in exactly the same manner as the previously discussed right-hand part of the powder coating booth 1.

In order to avoid an accumulation of powder in the two powder suction channels 7 and 8, the two powder suction channels 7 and 8 may be made of metal, preferably of alloy steel. Designing the two suction channels 7 and 8 in metal has the additional advantage that any part of the powder that may still be eletrostatically charged will be become discharged due to the conductive properties of the metal.

At the centre of the floor 4 there is arranged an air distribution batten 9 that is supplied with compressed air by means of compressed air hoses 11 situated below the floor. To this end the floor 4 is provided with appropriate borings to permit the connection of the compressed air hoses 11. With the help of the air distribution batten 9 arranged on the floor, the compressed air is blown is blown substantially parallel to the floor 4 in the direction of the suction apertures 7.1 and 8.1. In this way it is possible to free the floor 4 of excess powder. With a view to freeing also the oblique surfaces 5 and 6 of powder, a further air distribution batten 13 or 14 is arranged in the left-hand side wall 2 and the right-hand side wall 3. As can be seen in FIG. 1, the two additional air distribution battens 14 and 13 are integrated into the two side walls 2 and 3 and constitute a flush surface with the interior faces 2.1 and 2.1 of the side walls 2 and 3. This avoids an accumulation of powder on the lateral air distribution battens 13 and 14. The two lateral air distribution battens 13 and 14 are supplied by means of compressed air lines 18.

When the floor 4, the suction channels 7 and 8 and the oblique surfaces 5 and 6 are arranged as shown in FIG. 1, it becomes possible for the floor 4 of the powder coating booth 1 to be arranged at a relatively low level. This further increases the ease with which one can walk in the booth. Another advantage is that one can either reduce the overall height of the booth 1 or enlarge the entry opening for the parts that are to be coated. Furthermore, there is no need to provide a sump.

In order to avoid excess powder adhering to the floor 4, the floor may be provided with a surface made of plastic material, PVC for example. The inclination of the two oblique surfaces 5 and 6 with respect to the horizontal depends on the particular way in which the powder coating booth 1 is designed. Given the design illustrated by FIGS. 1 and 3, the angle of inclination $\alpha$ amounts to 45°.

Figure 2:
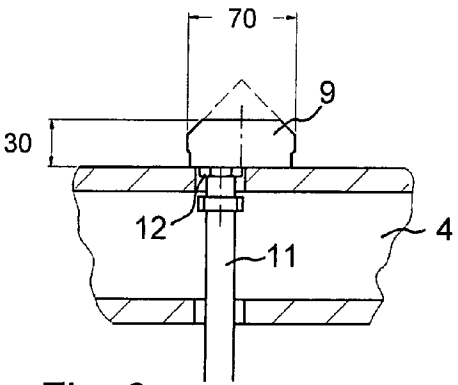
FIG. 2 shows a detail view of the air distribution batten arranged on the floor.

The air distribution batten 9 arranged on the floor is drawn to a greater scale in FIG. 2, which also shows a portion of the floor 4. The dimensions of the air distribution batten shown in FIG. 2 represent only indicative values. Thus, the air distribution batten 9 may have a width of 70 mm and a height of 30 mm. The compressed air hose 11, introduced from below and through the floor, is attached to the air distribution batten 9 by means of a screw connection. The design of the air distribution batten 9 will be described in greater detail in connection with FIGS. 5 to 9.

Figure 3:
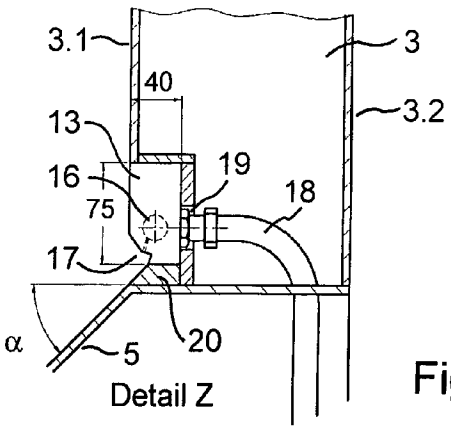
FIG. 3 shows a detail view of an air distribution batten integrated into the side wall of the booth.

FIG. 3 shows the structure and the arrangement of the air distribution batten 13 integrated into the right-hand side wall 3 in greater detail. The air distribution batten employed in this embodiment has a width of 40 mm and a height of 75 mm. Here, once again, the stated dimensions are purely indicative and given by way of example. The subsection of the air distribution batten 13 is provided with an air channel 16 that is supplied with compressed air via the compressed air line 18. The air channel 16 extends over the entire length of the subsection of the air distribution batten 13 and is provided with several air nozzles 17 that are oriented in the direction of the oblique surface 5. A wedge 20 may be arranged below the air distribution batten 13. The joint between the compressed air line 18 and the air distribution batten 13 may be effected, for example, by means of a screw connection 19.

Figure 4:
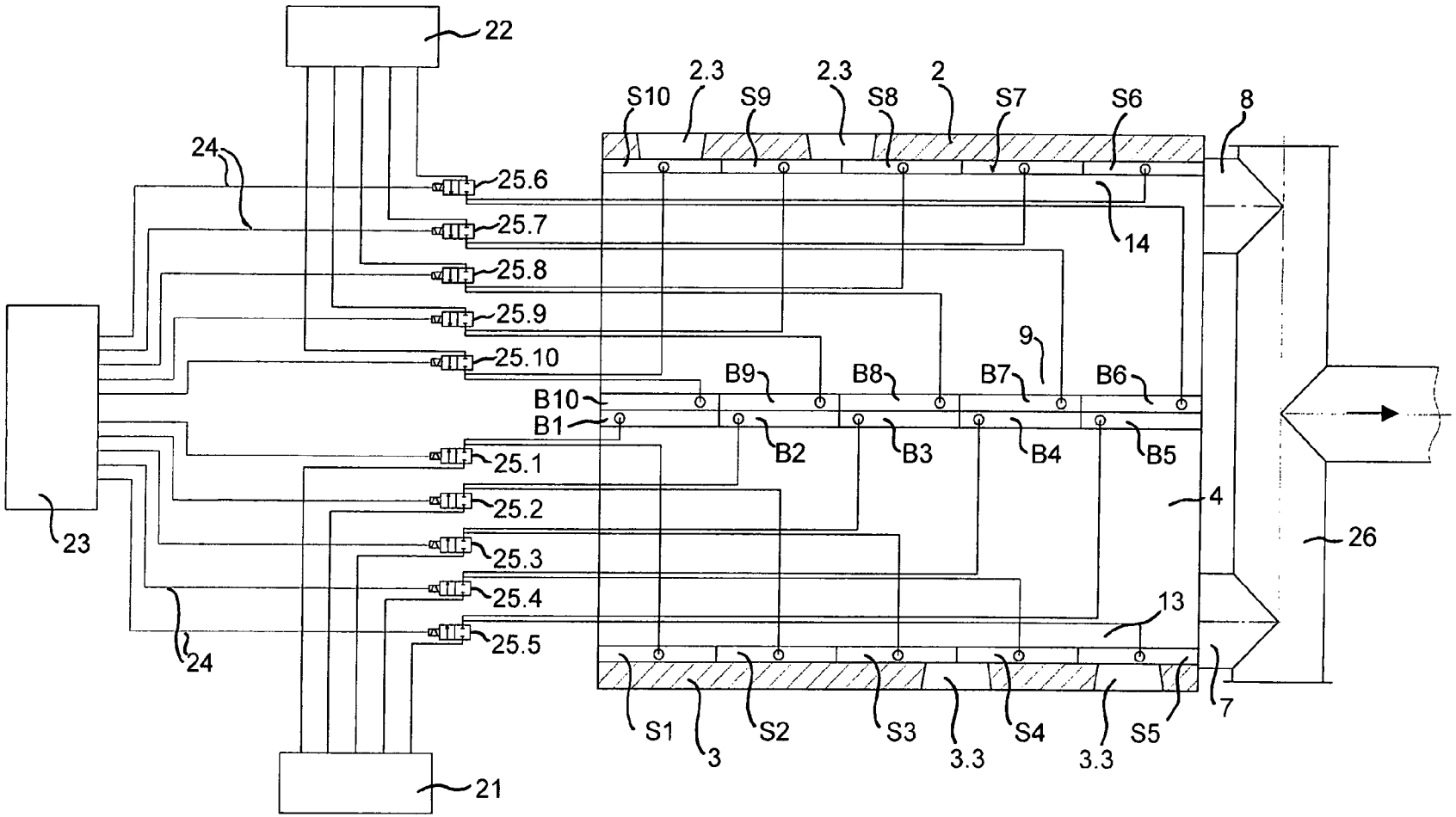
FIG. 4 shows a schematic representation of the arrangement of the individual air distribution battens and their control.

FIG. 4 shows a plan view of the powder coating booth 1 together with the controls and the individual compressed air lines. At the centre of the floor 4 of the booth 1 there is arranged the air distribution batten 9, which consists of several air distribution batten subsections B1 to B10 and extends over the entire length of the floor 4. The air distribution batten 14 arranged on the left-hand side 2 of the booth 1 likewise consists of several air distribution batten subsections S6 to S10. The same applies as regards the air distribution batten 13 arranged on the right-hand side 3 of the booth 1. It is made up of the individual air distribution batten subsections S1 to S5. The suction channels 7 and 8 arranged below the oblique surfaces lead out of the booth 1 and transport the excess powder sucked from the booth into, for example, a powder container, via a joint suction channel 26. One air distribution batten subsection of the central batten and one air distribution batten subsection of a lateral batten, for example B1 and S1 or B9 and S9, always receive their compressed air supply through a common control valve. For example, the valve 25.1 thus supplies the two air distribution batten subsections B1 and S1, while valve 25.4 supplies the two air distribution batten subsections B4 and S4. Since a total of 20 air distribution batten subsections are available, it thus follows that 10 control valves 25.1 to 25.10 are provided. In the embodiment illustrated by FIG. 4, the control valves 25.1 to 25.5 receive the necessary compressed air from a first compressed air container 21, while the five control valves 25.6 to 25.10 receive their compressed air from a second compressed air container 22. The valves 25.1 to 25.10 are controlled by means of a control unit 23 that is connected to the 25.1 to 25.10 by means of appropriate control lines 24.

For the sake of completeness, one should here mention also that the booth 1 is provided with openings 2.3 in the side wall 2 and with openings 3.3 in the side wall 3, by means of which powder spray pistols can be introduced into the interior of the booth 1 in order to spray powder onto the object to be coated that is situated in the booth 1. The powder spray pistols and the object to be coated are not shown in FIG. 4.

By virtue of the fact that two air distribution batten subsections are always controlled by means of a single valve, one obtains that air is blown out simultaneously through both subsections. This has the advantage of making it possible to improve the cleaning effect. Air is thereby blown simultaneously over the oblique surface and the floor, while the airstreams meet in the region of the suction slot and therefore exert a braking effect on each other. When the individual valves 25.1 to 25.10 are opened and closed sequentially one after the other with the help of the control unit 3, the total of ten floor segments will be cleaned in the sequence in which the valves are operated. This has the advantage of making possible a reduction of the overall compressed air consumption per unit of time, and also a reduction of the noise load during the cleaning of the floor 4 and the oblique surfaces 5 and 6.

Figure 5:
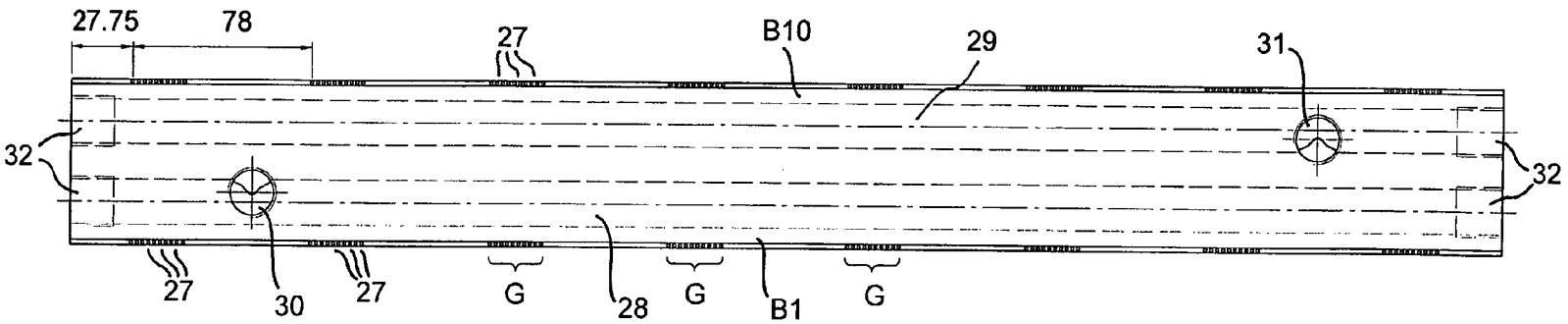
FIG. 5 shows two subsections of the air distribution batten arranged on the floor as seen from above.
Figure 10:
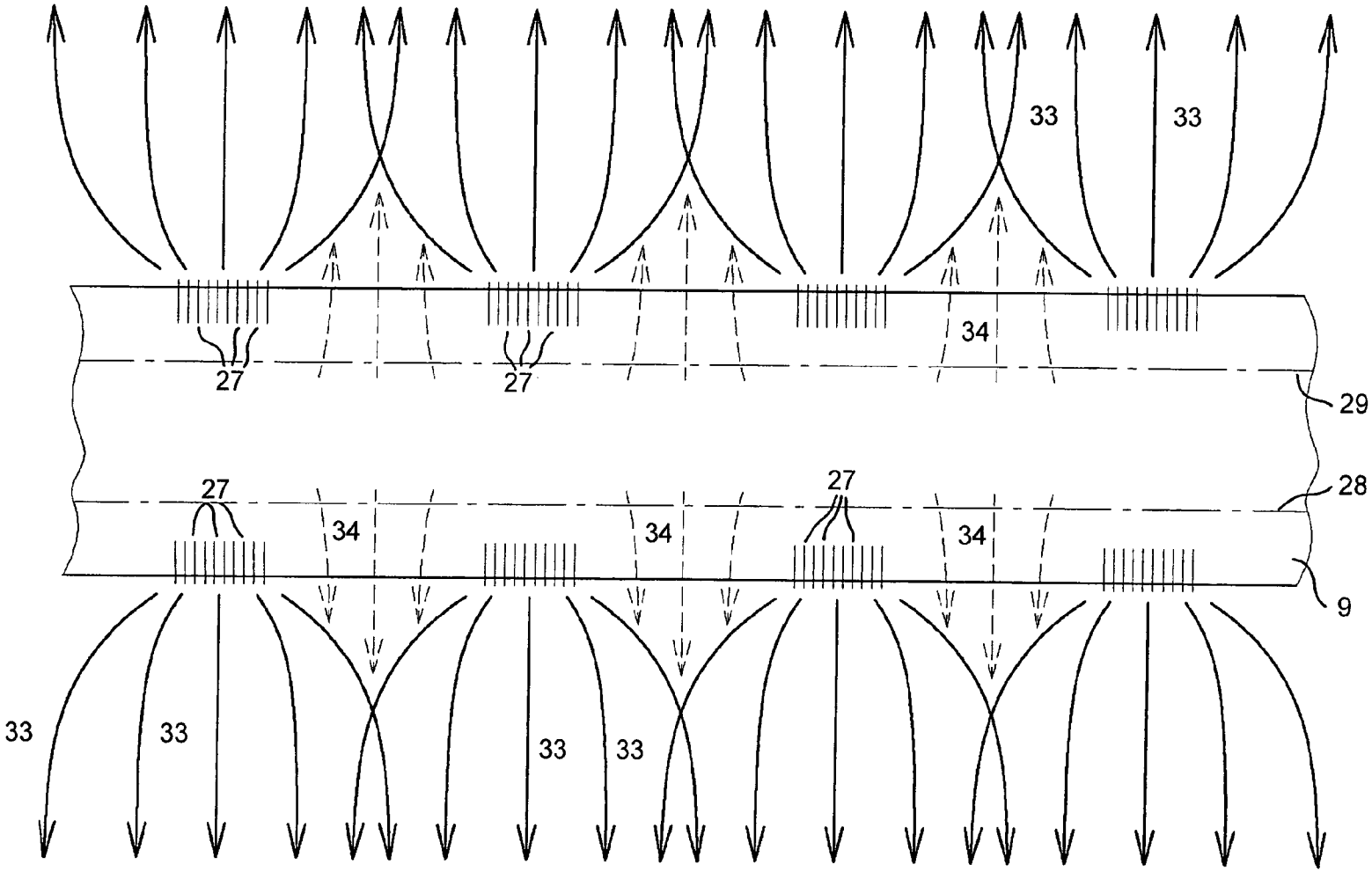
FIG. 10 shows the distribution of the airstream that can be produced by means of the air distribution batten arranged on the floor.

FIG. 5 illustrates the structure of two adjacent subsections of the air distribution batten 9 on the booth floor, here seen in plan. All the subsections of the air distribution batten basically have the same structure. The air distribution batten is provided with two air channels 28 and 29, each closed by means of two fasteners 32 at the ends of the distribution batten subsection. The first air channel 28 is part of the first subsection B1, while the second air channel 29 is part of the second subsection B10. The first air channel 28 is supplied with compressed air by means of the boring 30, while the second air channel 29 is supplied by means of the boring 31. Attached to each of the borings 30 and 31 is a compressed air line 11. The two air distribution batten subsections B1 and B10 are provided with borings 27 in a direction transverse to the air channels 28 and 29 that constitute the nozzles from which the air can issue. The nozzles 27 are combined into groups G. The embodiment illustrated by FIG. 5 comprises a total of 16 such nozzles combined into groups G. Such an arrangement of the nozzles 27 has the advantage that there is formed an air carpet that consists of the streams 33 of compressed air produced directly by the nozzles and the secondary airstreams 34 that result from these streams 33 of compressed air, all as shown in FIG. 10. Consequently, a substantial cleaning effect can be obtained even with a small quantity of compressed air.

Figure 6:
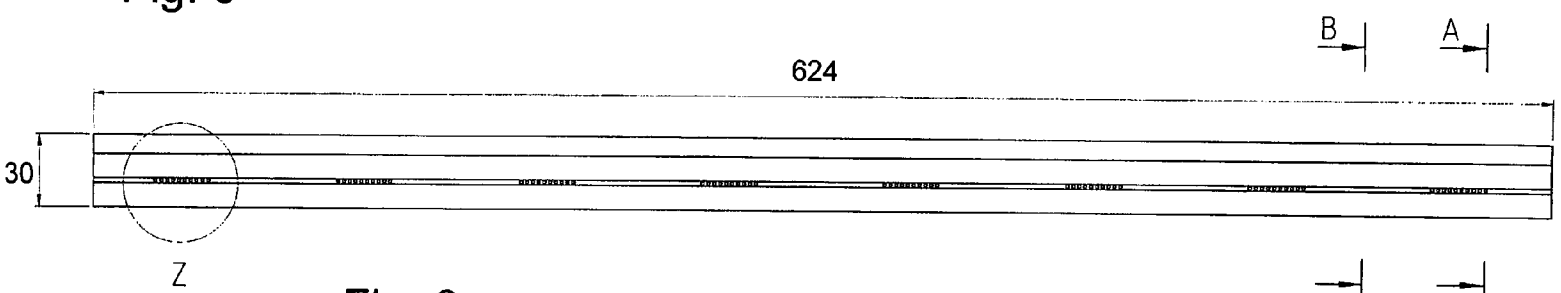
FIG. 6 shows a side elevation of one subsection of the air distribution batten arranged on the floor.
Figure 9:
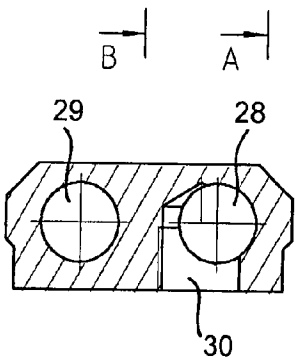
Figure 8:
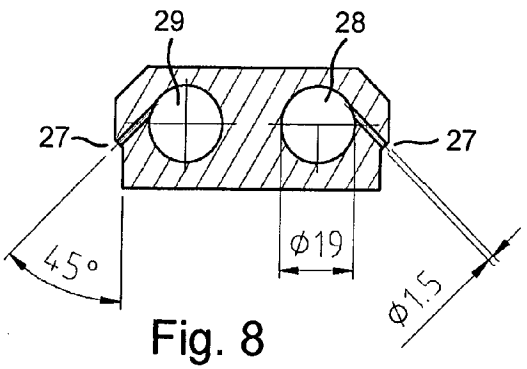
FIG. 8 shows a cross section through the air distribution batten arranged on the floor.
Figure 7:
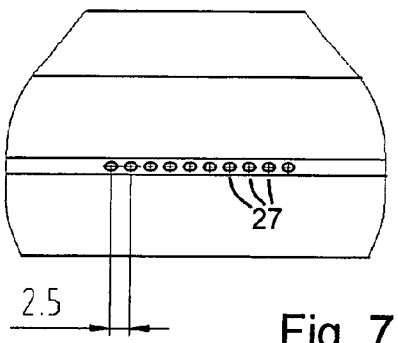
FIG. 7 shows a subsection of the air distribution batten to a greater scale.

FIG. 6 shows a side elevation of an air distribution batten subsection. FIG. 7 show the arrangement of the individual distribution nozzles 27 in greater detail. The distance between the individual distribution nozzles 27 may amount to, for example 2.5 mm. FIG. 8 shows a section through the air distribution batten subsections along the line A—A. The borings that are arranged at right angles to the air channels and constitute the nozzles 27 may be arranged at an inclination of 45° with respect to the vertical. Due to this arrangement one obtains the formation of an airstream carpet that spreads essentially parallel to the floor 4 of the powder coating booth 1. FIG. 9 shows a section along the line B—B of the two air distribution battens. The air distribution batten subsection B1 is provided with a pocket hole 30 by means of which the air channel 28 can be supplied with compressed air from below. The same applies in general principle also as regards the air distribution batten subsection B10, whose air channel 29 is connected with the pocket hole 31.

Figure 11:
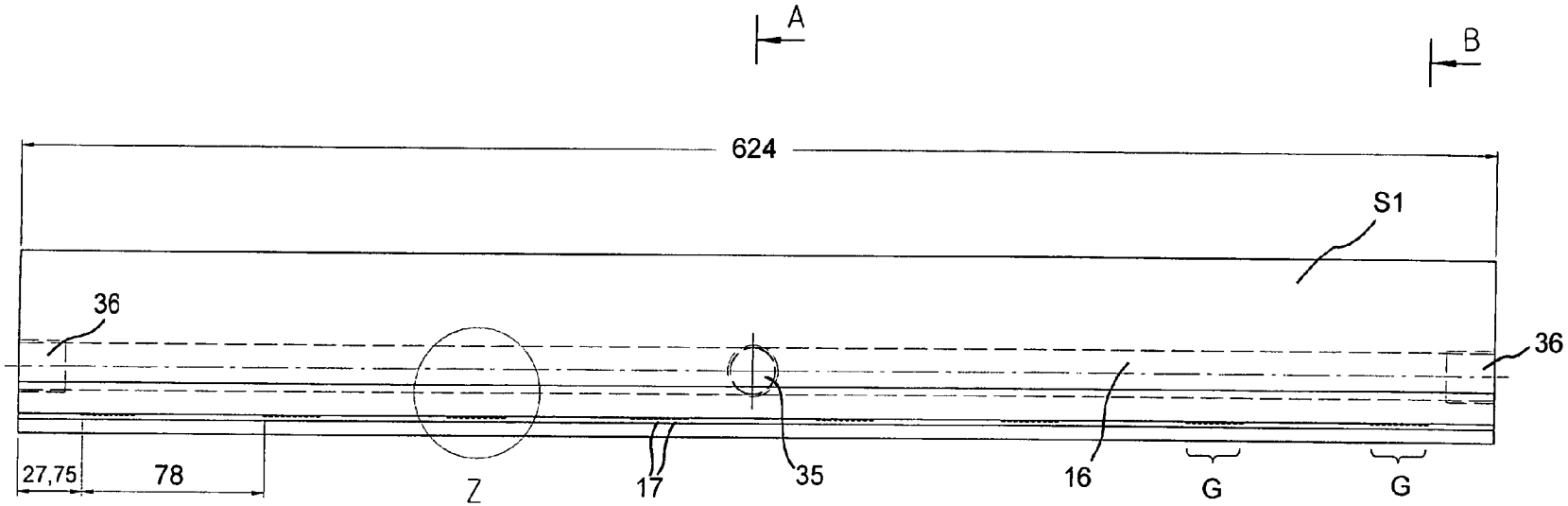
FIG. 11 shows a side elevation of a subsection of an air distribution batten that can be integrated into the side wall.

FIG. 11 illustrates an air distribution batten subsection S1 of the laterally arranged air distribution batten 13. In general principle, all the air distribution subsections of the laterally arranged air distribution batten 14 have the same structure. In the longitudinal direction of the air distribution batten subsection S1 there extends an air channel 16 that is closed at both ends of the air distribution batten subsection S1 with fasteners 36. A boring 35 is provided at right angles to the air channel 16 and serves to supply the air channel 16 with compressed air. The compressed air contained in the air channel 16 is blown out through borings that are likewise arranged at right angles to the air channel 16 and constitute the air nozzles 17. Just as in the case of the air distribution batten 9, which is arranged on the floor, the air distribution batten subsection S1 is provided with air nozzles 17 that are arranged in groups G. The embodiment illustrated by FIG. 11 comprises a total of eight such groups.

Figure 12:
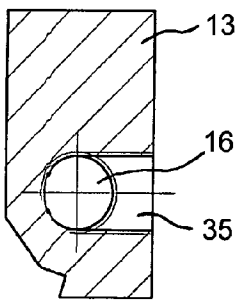
FIG. 12 shows a first cross-sectional representation of the air distribution batten that can be integrated into the side wall.

FIG. 12 shows a section through the distribution batten subsection S1 along the line A—A.

Figure 13:
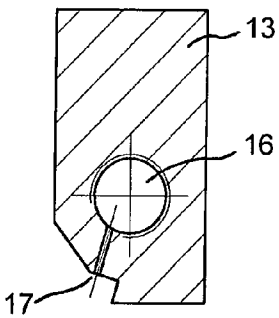
FIG. 13 shows a second cross-sectional representation of the air distribution batten that can be integrated into the side wall.

FIG. 13 shows a section through the distribution batten subsection S1 along the line B—B. The angle at which the air nozzles 17 are inclined with respect to the horizontal depends on the angle of inclination a of the oblique surfaces 5 and 6. When the angle of inclination $\alpha$ of the oblique surfaces 5 and 6 amounts to 45°, the angle at which the nozzles 17 are inclined with respect to the horizontal may amount to 106°.

Figure 14:
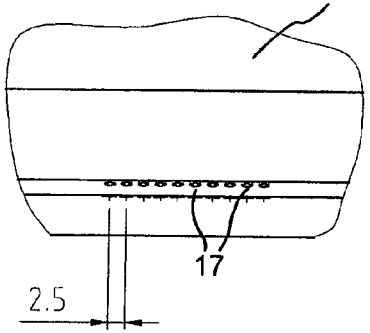
FIG. 14 shows a subsection of the air distribution batten that can be integrated into the side wall drawn to a larger scale.

FIG. 14 illustrates the arrangement of the individual distribution nozzles 17 in greater detail. As already mentioned, they may be interspaced at distances of, for example, 2.5 mm.

The number of the necessary air distribution batten subsections S1 to S10 and B1 to B10 depends on the application case and the length of the powder coating booth 1.

The use of such a cleaning device, of course, is not limited to a powder coating booth of the type shown in FIG. 4. The cleaning device may also be used for a round powder coating booth, in which case the individual air distribution batten subsections will be arranged along the circumference of the booth.

Given an air distribution batten 9 arranged at the centre of the floor 4 and designed as described hereinabove, a floor having a width of about 2 m can be cleaned in a problem-free manner. Following appropriate adaptation of the distribution batten and/or the air pressure, it also becomes possible to clean narrower or wider floors.

The distribution nozzles 27 of the air distribution batten 9, as also the distribution nozzles 17 of the air distribution battens arranged on the sides, are always oriented in such a manner as to produce an airstream towards the suction aperture 7.1 and/or 8.1. With a view to assuring that the particles that have been whirled up will be completely sucked out of the booth, it will be advantageous if the quantity of air sucked out of the booth is greater than the quantity of compressed air blown out through the nozzles 17 and 27. Advantageously, the intermittent sequential operation described hereinabove makes it possible to reduce not only the compressed air, but also the air sucked out of the booth.

The metal of the suction channels 7 and 8 prevents the powder particles from becoming charged due to friction. The diameter of the two suction channels 7 and 8 depends on the length and height of the booth. The greater the necessary suction power, the greater will be the chosen design diameter of the two suction channel 7 and 8.

Care should be taken to make the speed at which the air issues from the cleaning nozzles sufficiently low to prevent powder incrustations from coming into being on the floor 4 of the powder coating booth 1.

The vertical surfaces 5.2 and 6.2 and/or the oblique surfaces 5.2' and 6.2' further improve the capacity of sucking out the excess powder. This avoids the possibility of powder issuing from the booth 1 during the cleaning process. It also renders possible a further lowering of the booth floor 4.

Should this be desired, the air distribution battens 9, 13 and 14 may be operated exclusively during the time the powder coating booth is in operation. But it is also possible for either all or only some of the air distribution battens 9, 13 and 14 being used to provide additional support for the cleaning carried out after the operation of the booth.

The above description of embodiments in accordance with the present invention is intended only for illustrative purposes and not for the purpose of limiting the invention. Various changes and modifications are possible without thereby overstepping the scope of the invention and its equivalents.

What is claimed is:

1. A device for cleaning a powder coating booth,
with a first air distribution batten that is provided for the floor of the powder coating booth,
with a second air distribution batten that is provided for a side of the powder coating booth,
with a suction channel provided with a suction slot to suck excess powder out of the booth, wherein the first and the second air distribution battens are provided to blow excess powder in the direction of the suction slot, wherein the first air distribution batten comprises several batten subsections, and wherein each of the batten subsections can be activated independently of the other batten subsections.

2. A device in accordance with claim 1,
with a third air distribution batten that is provided for a second side of the powder coating booth, and
with a second suction channel provided with a suction slot,
wherein the third air distribution batten is provided to blow excess powder in the direction of the suction slot of the second suction channel.

3. A device in accordance with claim 1,
wherein the second and/or the third air distribution batten consist of several batten subsections, through each of which air can be blown out independently of the others.

4. A device in accordance with claim 3,
with a control, by means of which the batten subsections can be individually controlled.

5. A device in accordance with claim 3,
wherein two batten subsections lying opposite each other are always operated by means of a single valve.

6. A device in accordance with claim 1,
wherein the first and/or the second and/or the third air distribution batten are provided with several nozzles that are arranged in such a manner that the airstream produced by the nozzles is substantially oriented at right angles to the longitudinal axis of the air distribution batten.

7. A device in accordance with claim 6,
wherein the nozzles of the first air distribution batten are arranged in such a manner that the airstream that can be produced by the nozzles is substantially oriented parallel to the floor.

8. A device in accordance with claim 1,
wherein the first air distribution batten is provided with nozzles on both sides of its longitudinal axis.

9. A device in accordance with claim 1,
wherein the first and/or the second and/or the third air distribution batten are provided with nozzles arranged in groups.

10. A device in accordance with claim 1,
with a container for a reserve supply of compressed air that is connected with the air distribution battens.

11. A device in accordance with claim 1,
wherein the first and/or the second and/or the third air distribution batten extend substantially over the length of the floor in the powder coating booth.

12. A device in accordance with claim 1,
wherein the first and/or the second and/or the third air distribution batten are made of plastic material.

13. A powder coating booth with cleaning device,
with a first air distribution batten that is arranged on the floor of the powder coating booth,
with a second air distribution batten that is arranged on a side of the powder coating booth, and
with a suction channel provided with a suction slot,
wherein the first and the second air distribution batten are provided to blow excess powder in the direction of the suction slot, wherein the first air distribution batten comprises several batten subsections, and wherein each of the batten subsections can be activated independently of the other batten subsections.

14. A powder coating booth in accordance with claim 13,
wherein the suction slot is situated between the side and the floor of the powder coating booth.

15. A powder coating booth in accordance with claim 13,
with a second suction channel provided with a suction slot,
wherein the first and the second suction channel extend along the long side of the powder coating booth.

16. A powder coating booth in accordance with claim 13,
with an oblique surface that constitutes the transition between the side and the floor, and wherein the second and/or the third air distribution batten are arranged above the oblique surface.

17. A powder coating booth in accordance with claim 16,
wherein the oblique surface is provided with a bevelled edge in its lower region and the surface formed by the bevelled edge encloses an acute angle with the floor.

18. A powder coating booth in accordance with claim 16,
wherein the nozzles of the second and/or the third air distribution batten are oriented in such a manner that the airstream that can be produced by the nozzles is oriented substantially parallel to the oblique surface.

19. A powder coating booth in accordance with claim 13,
wherein the first air distribution batten is arranged at the centre of the floor of the powder coating booth.

20. A powder coating booth in accordance with claim 13,
wherein the second air distribution batten is integrated into a side wall of the powder coating booth and constitutes a flush surface therewith.

21. A powder coating booth in accordance with claim 13,
that is designed in such a manner that the airstream produced by the nozzles is smaller than the airstream sucked out of the booth.

22. A powder coating booth in accordance with claim 13,
wherein the first and/or the second suction channel is made of metal.

23. A device in accordance with claim 12,
wherein the first and/or the second and/or the third air distribution batten are made of at least one of PVC, POM or polytetrafluoroethylene.

24. A powder coating booth in accordance with claim 22,
wherein the first and/or the second suction channel is made of an alloy steel.

* * * * *